US006415869B1

(12) United States Patent
Smith

(10) Patent No.: US 6,415,869 B1
(45) Date of Patent: Jul. 9, 2002

(54) METHOD OF DEPLOYING AN ELECTRICALLY DRIVEN FLUID TRANSDUCER SYSTEM IN A WELL

(75) Inventor: David Randolph Smith, Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/606,389

(22) Filed: Jun. 29, 2000

(30) Foreign Application Priority Data

Jul. 2, 1999 (EP) ..... 99202160

(51) Int. Cl.[7] ..... E21B 23/00
(52) U.S. Cl. ..... 166/381; 166/65.1; 166/378
(58) Field of Search ..... 166/65.1, 105, 166/378, 380, 381

(56) References Cited

U.S. PATENT DOCUMENTS

| | | | | | |
|---|---|---|---|---|---|
| 3,835,929 | A | | 9/1974 | Suman, Jr. | 166/315 |
| 3,939,705 | A | | 2/1976 | Glotin et al. | 73/151 |
| 4,105,279 | A | | 8/1978 | Glotin et al. | 339/117 R |
| 4,494,602 | A | | 1/1985 | Capdeboscq et al. | 166/65 R |
| 4,589,717 | A | | 5/1986 | Pottier et al. | 339/94 M |
| 4,767,349 | A | * | 8/1988 | Pottier et al. | 439/191 |
| 4,921,438 | A | | 5/1990 | Godfrey et al. | 439/190 |
| 5,131,464 | A | * | 7/1992 | Lenhart et al. | 166/65.1 |
| 5,180,140 | A | | 1/1993 | Araki | 251/291 |
| 5,191,173 | A | | 3/1993 | Sizer et al. | 174/105 |
| 5,358,418 | A | * | 10/1994 | Carmichael | 439/190 |
| 5,746,582 | A | | 5/1998 | Patterson | 417/53 |
| 5,820,416 | A | * | 10/1998 | Carmichael | 439/668 |
| 5,823,257 | A | * | 10/1998 | Peyton | 166/65.1 |
| 5,871,051 | A | | 2/1999 | Mann | 166/377 |
| 5,984,568 | A | * | 11/1999 | Lohbeck | 403/375 |

FOREIGN PATENT DOCUMENTS

| | | |
|---|---|---|
| EP | 0470576 A1 | 2/1992 |
| EP | 0745176 B1 | 4/1998 |
| WO | 98/22692 A1 | 5/1998 |

* cited by examiner

*Primary Examiner*—David Bagnell
*Assistant Examiner*—Jennifer R Dougherty

(57) ABSTRACT

A method of retrievably deploying an electrically driven downhole well fluid transducer system, such as an electrical submersible pump (ESP), comprises installing a production tubing, which is equipped near its lower end with one part of a wet mateable electrical connector and an external electric conduit, and subsequently lowering the fluid transducer system, which is equipped with another part of a wet mateable electrical connector through the tubing until the wet mateable connector parts engage each other.

19 Claims, 1 Drawing Sheet

METHOD OF DEPLOYING AN ELECTRICALLY DRIVEN FLUID TRANSDUCER SYSTEM IN A WELL

FIELD OF THE INVENTION

This invention relates to a method of deploying an electrical submersible powered fluid transducer system, such as a gas compressor or an electrical submersible pump, generally known as an ESP, in an oil and/or gas production well.

BACKGROUND OF THE INVENTION

The disposing in wells of electrical submersible systems has been done for many years using jointed tubular conduits with an electrical motor, and a fluid transducer connected to the bottom of the jointed tubing.

Consecutive joints of tubular conduits are connected and lowered into a well with the assistance of a rig mast and hoisting equipment, whilst unspooling and connecting to the outer diameter of the tubing a continuous length of electrical power transmission cable. This method of disposing the electrical submersible fluid transducer system is well know to those familiar with the art of producing non-eruptive sources of oil and gas from the subterranean environment.

The retrieval of these electrical submersible fluid transducer systems is also commonly accomplished by pulling the jointed tubing out of the well simultaneously with the electrical submersible motor and fluid transducer system and the electrical power transmission cable.

The following prior art references are believed to be pertinent to the invention claimed in the present application: U.S. Pat. Nos. 3,939,705; 4,105,279; 4,494,602; 4,589,717; 5,180,140; 5,746,582 and 5,871,051; International patent application No. WO98/22692 and European patent specifications Nos. 470576 and 745176.

U.S. Pat. Nos. 3,835,929, 5,180,140 and 5,191,173 teach the art of deploying and retrieving an electrical submersible system in oil wells using coiled, or continuous tubing. These coiled tubing disposal methods often use large coiled tubing spool diameters owing to the radius of curvature possible of the continuous tubing. Hence the surface spooling devices that these systems require to inject and retrieve the continues tubing are cumbersome, and require special surface and subterranean equipment for deployment and intervention. These methods all teach the retrieval of the power cable with the continuous tubing for replacement of the equipment.

Other previous art disclosed in the literature teaches the disposal and retrieval of the subterranean electrical fluid transducer system with wireline or wire rope as structural support for simultaneously disposing the electrical power transmission cable with the system. Hence these wireline methods and apparatus involve the use of large and unique surface intervention equipment to handle the weight and spool used for the electrical power cable and the wire rope, to be run simultaneously with the power cable in the well. These methods teach the retrieval of the electrical submersible power transmission cable with the submersible electrical motor.

U.S. Pat. No. 5,746,582 discloses the retrieval of a submersible pumps whilst leaving an electrical motor and cable in a well. Hence the method of U.S. Pat. No. 5,746,582 teaches the retrieval and deployment of the mechanically portion of an electrical submersible fluid transmission system whilst leaving the electrical motor and other component parts of the electrical submersible system disposed in the well. U.S. Pat. No. 5,746,582 does not teach the retrieval or disposal of the electrical motor separately from the electrical power transmission cable.

In the case of artificially lifted wells powered with electrical submersible motor systems, the current art is to dispose the required transducer assembly, for example a pump or compressor assembly, with an electrical motor and electrical power cable simultaneously into the well with a supporting member. This supporting member is jointed tubing from a surface rig, a coiled tubing unit with continues tubing or braided cable. The tubing or a braided cable is required as the electrical power cable is not able to support it's own weight in the well and hence must be connected and disposed in the well with a structural member for support.

In the case of jointed pipe deployed from a rig, the power cable is attached to the electrical motor on surface, and the cable is attached to the tubing as the electrical motor, transducer, and tubing are disposed into the well casing or tubing. The attachment of the cable to the tube is done by the use of steel bands, cast clamps, and other methods known to those familiar with the oil and gas business.

In other methods, the power cable is placed inside of continuous tubing or attached to the outside of continuous tubing with bands as taught by U.S. Pat. No. 5,191,173. This continuous tubing is often referred to in the industry as coiled tubing. U.S. Pat. No. 3,835,929 teaches the use of the continuous tubing with the electrical power transmission cable inside of the tube.

In all cases where electrical submersible fluid transducers systems are disposed and retrieved from wells the electric motor and electrical power transmission cable are deployed or retrieved simultaneously.

It is well known to those familiar with electrical submersible power cable that the action of removing the cable from the well can result in damage to the electrical power transmission cable, in a variety of ways. The damage inflicted on the electrical power cable can be due to bending stresses imposed on the cable during the disposal and retrieval. The conventional electrical power cable insulation, wrapping, and shields can develop stress cracks from the spooling of the cable over sheaves and spools devices used to deploy the cable. Another failure mode associated with submersible power transmission cable is caused form impact loads or crushing of the cable as it is disposed or retrieved in the wells. It is also well known that gases found in subterranean environments impregnated the permeability of the electrical power transmission cable's insulation, wrapping and shields. This gas is trapped in the permeability of the insulation at a pressure similar to the pressure found inside the well. When the cable is retrieved from the well the electrically powered transmission cable is exposed to ambient pressures. This will create a pressure differential between gas encapsulated in the cable insulation and the ambient surface pressure conditions. The rate of impregnated gas expansion from the higher pressure inside of the cable insulation expanding towards the lower pressure of the ambient conditions can sometimes exceed the cable insulation permeability's ability to equalize the pressure differential. The result is a void, or stressing of the insulation, and premature failure of the cable.

The requirement to retrieve and dispose the electrical power transmission cable with the electrical submersible fluid traducer system also requires the use of specialized surface intervention equipment. This can require very large rigs, capable of pulling tubing, electrical power transmission cable, and electrical submersible fluid transducers. In the offshore environment these well intervention methods require semi-submersible drill ships and platforms. In the case of jointed conduit deployed in a plurality of threaded lengths, normally 9–12 m each, the pulling equipment is a drilling or pulling rig at surface. In the case that the electrical power transmission cable and assembly are disposed connected to or in continuous tubing, a specialized coiled tubing rig is required at surface. This coiled tubing unit consisting of an injector head, a hydraulic power unit, and a large diameter spooling device containing the continuous coiled tubing all located on the surface. This disposal and retrieval method requires significant space at the earth's surface or sea floor.

The reasons for intervening in a well to retrieve or dispose an electrical submersible transducer system are well know to those familiar with the art of fluid removing fluids from wells. There are at least two classical reasons for intervention in wells disposed with electrical submersible fluid transducer systems. These include the need to increase fluid production, or the need to repair the disposed electrical submersible power system.

The reason for requiring increased fluid production is dependent on many factors including but not limited to economical and reservoir management techniques discussed in the literature.

The reasons for intervening for repair or to replace the electrical submersible fluid transducer systems are due to normal equipment wear and the subsequent loss of fluid production capacity, catastrophic equipment failure, and changes in the fluid production capacity of the subterranean fluid reservoir.

The equipment failures can be caused due to subterranean electrical failures in the electrical motor windings, electrical motor insulation degradation due to heat or mechanical wear, conductive fluid leaking into the motor, wear or failure of the fluid transducer parts, wear of electrical motor bearings, shaft vibrations, changes in inflow performance of the reservoir, and other phenomena known to those familiar with the art of fluid production from wells. Therefore, it is often required to change out component parts of the electrical submersible fluid transducer system, but not necessarily the electrical power transmission cable. However, owing to prior art the power cable is retrieved when the electrical motor or the motor seals fail.

The current invention is an improvement to the known art of well construction, this invention teaches operational methods and claims apparatus related to disposing, operating, and retrieving electrical submersible fluid transducers systems. More particularly, the invention's methods and apparatus enables the electrical power transmission cable to remain in the well whilst teaching a plurality of retrieving and/or disposing well interventions for components of the electrical submersible fluid transmission system.

SUMMARY OF THE INVENTION

The method according to the invention comprises:

connecting an electrical power cable to a first part of a wet mateable electrical power connector which is secured to a lower region of a production tubing;

lowering the production tubing and the electrical power cable into the well;

lowering through the production tubing an electrically driven downhole fluid transducer system which is equipped with a second part of a wet mateable electrical power connector;

releasably latching the transducer system to the production tubing such that the two parts of the wet mateable power connector face each other;

injecting a dielectric fluid into a space between said electrical connector parts and sealing off said space to prevent influx of well fluids into said space; and activating the fluid transducer system by transmitting electrical power via the power cable and sealed electrical connector to the system.

Preferably a controlled descent of the transducer system through the tubing is facilitated by closing a valve which is located below the first, permanently installed, part of the electrical connector during the lowering procedure and by circulating fluids in a controlled manner down via the production tubing, via an opening in said tubing near said first connector part and up through a hydraulic conduit disposed with the production tubing through which conduit also dielectric fluid is subsequently injected between the electrical connector parts. It is also clear that another method for displacing the transducer assembly into the well would allow fluid to be displaced below the transducer assembly into the perforations or into the annular space between the production tubing and the casing.

DETAILED DESCRIPTION

A suitable wet mateable connector for use in the method according to the invention is disclosed in U.S. Pat. specification No. 4,921,438 which is incorporated herein by way of reference.

In the method according to the present invention it is furthermore preferred that a wireline adapter tool is located on top of the transducer assembly of the fluid transducer system and that the assembly is equipped with a displacement plug section which provides a seal between the transducer assembly and the production tubing during at least part of the step of lowering of the fluid transducer system through the well and wherein well fluids are extracted through the hydraulic conduit at a controlled rate to control and/or assist the descent of the fluid transducer system through the production tubing.

Suitably the fluid transducer is retrieved to surface by unlatching the transducer system from the production tubing, closing the check valve and pumping fluid into the hydraulic conduit thereby hydraulically lifting the assembly to surface.

Suitably the fluid transducer system may also be retrieved to surface or disposed in the well using a wire line or rope extending from surface, with the appropriate tools well known to those familiar with the art of wire line services for wells to accommodating the latching and releasing of the fluid transducer system.

Suitably the fluid transducer system may be retrieved to surface or retrieved from the well using a length of continuous tubing or a plurality of lengths of jointed tubing extending from surface down to the fluid transducer system, and using the appropriate tools well know to those familiar with the art of well services to latch on and pull the fluid transducer system to surface.

Suitably the fluid transducer system may be retrieved to surface or retrieved from the well using any combination of tubing, wire line, and hydraulic methods.

This invention also teaches that a fishing neck is connected to the top of the transducer system such that wireline and other tubing methods can be used to dispose and or retrieve the transducer system. This invention also teaches that a wiper plug be attached to the wireline or retrieval tubing to allow for hydraulic displacement and or retrieval of the transducer system, and to apply sufficient force to mate the two parts of the wet mateable electrical connector.

A preferred embodiment of the method and system according to the invention will be described in more detail with reference to the accompanying drawings.

Figure 1:
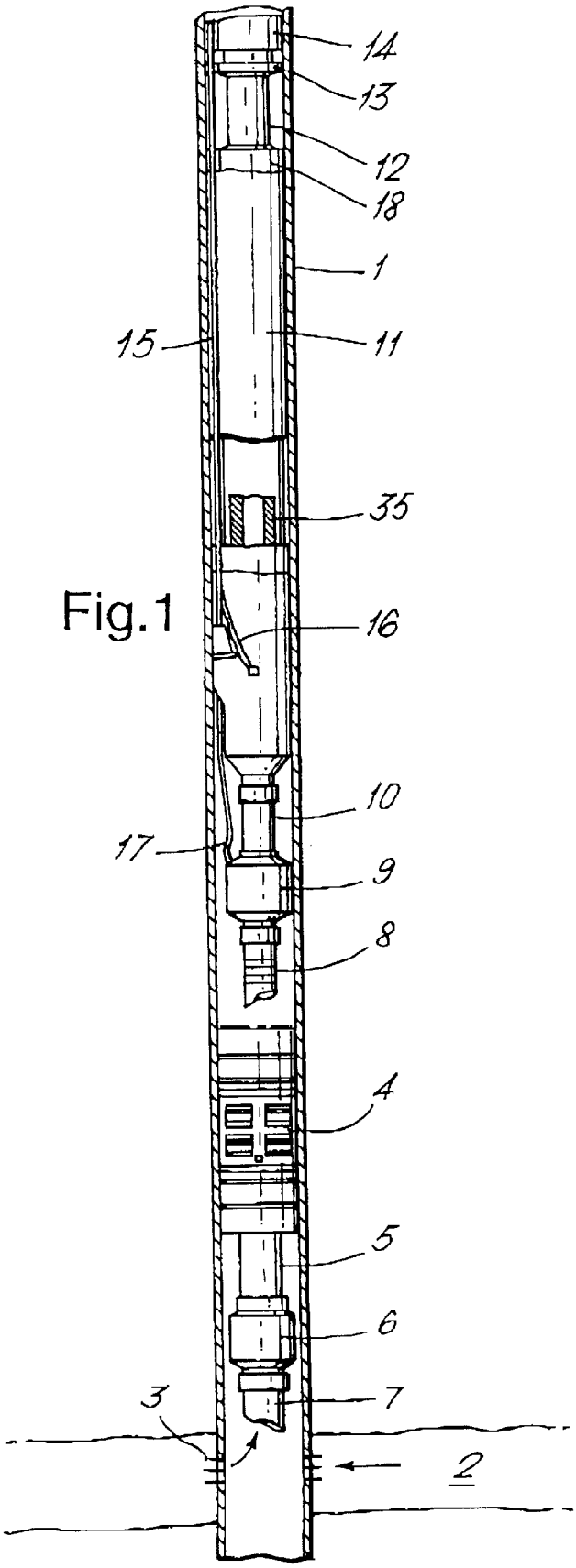
FIG. 1 illustrates how the production tubing, electrical power cable, submersible valve, hydraulic conduit and the male first part of the wet mateable electrical connector are installed permanently in an oil or gas well.

Referring to FIG. 1 a length of well casing 1 is shown in hydraulic communication with a subterranean reservoir 2 by a set of perforations 3 allowing fluids to enter the casing 1 from the reservoir 2.

Step one of the development process disposes a packer 4 in the well casing 1. Connected to and below this packer 4 is a lower tail pipe extension 5 connected to a check valve 6 and a wireline re-entry guide 7 using and said packer 4 is set in the casing 1 using common and known wireline packer setting technology. This portion of the well construction results in a packer 4 in gauging hydraulic slips into the inner wall of the casing 1 and forming a hydraulic seal between the packer 4 and the well casing 1. Said packer 4 has an inner bore that is smooth or sometimes referred to as polished so as to form a hydraulic seal tubular space for a sealing section to be disposed later. Said check valve 6 controls well fluid from flowing from above the packer 4 into the perforations 3 and reservoir 2 and also allows for the hydraulic displacement and retrieval fluids to be conducted to surface to allow for measurable control of the displacement and retrieval process without disposing fluids into the perforations.

In step 2 of the deployment process a sealing tube section 8 is connected to a sub-surface safety control valve 9 connected to a length or a plurality of lengths of jointed production tubing 10 which is then connected to an electrical landing module 11, where the electrical landing module has concentrically located in side an electrical receptacle 35, and said electrical landing module is connected at its upper end to production tubing 18 having in its inner diameter a polished bore 12 and a latching profile 13 which is then connect by a plurality of production tubing lengths 14 back to the wells surface well head.

Whilst disposing these apparatus in the well casing 1, the invention teaches the simultaneous disposing of lengths of electrical submersible power transmission cable 15 attached using bands and/or clamps to the outer surface diameter of the production tubing 14 with the electrical cable 15 extending down to the electrical landing module 11 where the electrical power transmission cable penetrates the electrical landing module 11. Whilst disposing these apparatus of this process in the well casing 1, the invention teaches the simultaneous disposing of lengths of continuous hydraulic conduit 16 and 17 forming at least 2 separate hydraulic conduit paths to surface and being attached using bands and or clamps to the outer diameter of the production tubing 14 where the hydraulic conduit 16 penetrates the electrical landing module 11 and the other hydraulic conduit 17 is connected to the sub-surface safety control valve 9.

This assembly described in step 2 of the construction process is then lowered until the seal section 8 penetrates the packer 4 and forms a hydraulic seal between the outer diameter of the seals of the sealing section 8 and the polished internal diameter of the packer 4. Once the assembly is landed into the previously disposed packer, the production tubing 14 is connected to a tubing hanger at the surface well head and the electrical cable 15, and various hydraulic conduit lines 16 and 17 are penetrated through the well head by known methods, such that a pressure seal is achieved at the well head between the production tubing 14 and the casing 1.

In another embodiment the construction process modifies the production tubing 14 by expanding it via the art of expandable tubing where in the internal diameter of the production tubing is increased by the forcing of a larger mandrel through the production tubing, hence increasing the internal diameter of the production tubing once it is disposed in side the casing 1 thereafter the expanded tubing is connected to the tubing hanger and wellhead.

The process of this invention connects a wellhead with all of the appropriate valves and safety devices. The preferred embodiment of the invention uses a full bore diameter well head that has an internal bore larger than the electrical transducer system which allows for the electrical transducer system to be pulled through the wellhead, tubing hanger and all valves in the wellhead.

It is clear to those familiar with the art of oil and gas production that the use of the packer 4 and the subsequent sealing section disposed in the casing 1 is not always necessary to the process of this invention. This depends on the actual well conditions and local legal regulations.

The result of this step of the process is that there is a hydraulic fluid path for the reservoir fluids to flow from the reservoir 2 through the perforations 3 up the tubular conduit formed by the wireline entry guide 7 the check valve 6 the tail pipe tubing or tubing joints 5 through the packer 4 concentrically through the seal section 8 with fluid flow then through the sub-surface control valve 9 through additional production tubing lengths 10 through and/or around the electrical landing module 11 up through the production tubing 18 through the polished bore section 12 through the latch profile and into the production tubing 14 to surface.

Figure 2:
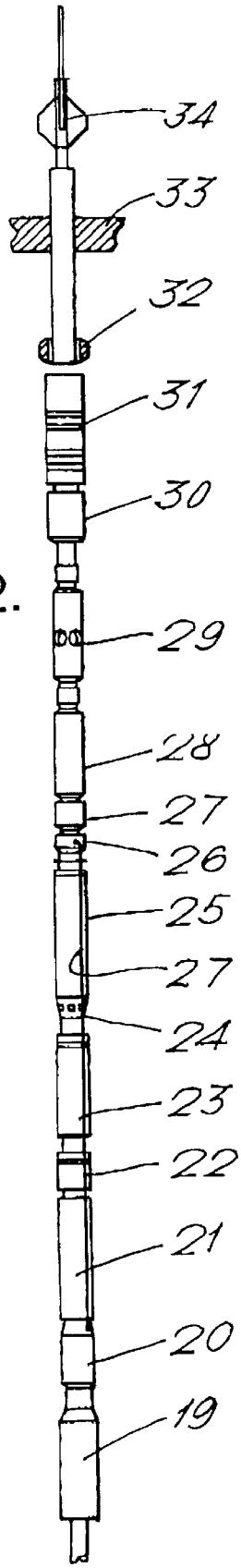
FIG. 2 illustrates how the electrical fluid transducer and the male second part of the wet mateable electrical connector are lowered on a wireline into the production tubing.

The third step in the well construction process of the preferred embodiment is to assemble the electrically powered fluid transducer components shown in FIG. 2. This assembly consists of a female one part of the electrical power receptacle 19 connect to a submersible telemetry package 20 which is then connected to an electrical motor 21 or a plurality of motors connected in series which are wired to said telemetry package 19 and mechanically connected to a second set of telemetry 22 devices which are then connected to the seal section 23 which is then connected to a fluid transducer intake 24 which is then connected to the fluid transducer 25 which is then connected to a tubing sub 26 with a hydraulic pressure port which has connected to its outer diameter a hydraulic conduit 27 running back down to the lower telemetry package 20 and said discharge pressure tubing sub 26 is connected on its top to a fluid transducer discharge head 37 which is then connected to a sliding sleeve device 28 which is then connected to a check valve sub 29 which is then connected to a telescoping device 30 which is then connected to a seal bore mandrel section 31 which is then attached to a latching device 32 which is then attached to a displacement plug section 33 which is connected to a continuous length of wireline 34, and the entire assembly is then disposed inside of the production tubing 14 and lowered on the wireline 34 into the production tubing 14.

The third part of the well construction process of the preferred embodiment is performed by lowering the electrical submersible fluid transducer assembly, shown in FIG. 2, by wireline methods and assisting the assembly's movement down the inside of the production tubing 14 by pumping fluid in the production tubing 14 until the electrical submersible fluid transducer assembly described in step 2 of the process, reaches the polished bore receptacle 12 which was predisposed using the first step of the preferred embodiment. By using increasing fluid pressure down the production tubing and controlling the pressure on the conduit 16 by means of valves and throttles on surface the landing of the electrical submersible fluid transducer is achieved by an extension of the telescoping section 30. This extension is achieved using a controlled displacement of fluids down the production tubing 14 with the safety valve 9 closed and fluid below the telescoping section 30 flowing into the conduit 16 which is connected to the electrical landing module 11. This fluid can be monitored on surface and controlled to assure a controlled landing of the female electrical receptacle 19 into the predisposed male electrical receptacle 35 to make a complete electrical circuit from the surface power grid through the electrical submersible power transmission cable 15 through the electrical landing module 11 and through the male electrical receptacle 35 into the female electrical receptacle 19 through the telemetry package 20 and into the electrical submersible motor or motors 21. This third step of the construction method of the preferred embodiment allows the electrical submersible fluid transducer to be landed and connected to the predisposed electrical receptacle already disposed by the first step of the process multiple times. At the end of the third step a dielectric fluid, such as an organic dielectric oil is displaced into the hydraulic conduit 15 into the annular space between the male and female electrical receptacle parts 35 and 19 until all well fluids have been flushed out of said space in the previously disposed part of the electrical connector and sealing rings subsequently retain the dielectric fluid within said space upon the completion of the connection of the two parts of the wet mateable connector on being from the previously disposed electric landing module and the other part of the electrical receptacle being located on the bottom of the motor.

The same hydraulic conduit 16 used to take the displacement of fluid during the landing operation can also be used to disconnect the electrical submersible fluid transducer system shown in drawing 2 from the electrical landing module 11 and then pulled to surface via wireline methods or further lifted via hydraulic pumping. The electrical submersible fluid transducer system can also be returned to surface solely with fluid displacement in the reverse direction, that is from surface down the conduit 16 with the safety valve at 9 closed forcing the electrical submersible fluid transducer assembly to be pumped only, without the assistance of a wireline 34, to surface by fluid displacement.

According to one preferred embodiment of the invention, the electrical motor assembly, motor sealing section, fluid transducer, various telemetry, and hydraulic control lines are disposed in the well simultaneously with the electric power transmission cable, tubing, and electrical landing assembly using a drilling or work over rig either at the surface of the earth.

According to the present invention the submersible electrically powered motor, fluid transducer, and other required components are disposed in a well in a novel way such that the electric motor can be extracted or disposed separately from the well whilst the electrical submersible power cable remains disposed in the well.

This invention then leaves said submersible electrical power cable in the well, whilst allowing the fluid transducer assembly, electric motors, motor seal sections, monitoring telemetry, fluid control devices, wet mateable electrical power connectors, and other components familiar to those versed in the art of transducing fluids from wells, can to be retrieved and deployed multiple times after the initial completion with simplified surface intervention equipment. This invention allows the multiple retrieval and deployment of electrical motors as well as the fluid transducers through a tubing conduit using simplified intervention equipment.

Simplified intervention equipment includes wireline-pulling units, coiled tubing units, and rigs for jointed pipe interventions without the need to pull the electrical power cable.

Preferably, as shown in FIG. 2, the electrical submersible power cable 15 is deployed on the tubing string 14, with the male a part of the electrical power connection 35 on the bottom, and a packer 4 and a polished bore receptacle, 2 control lines, PBR 12, inside of the tubing. This is then referred to in this document as the permanently disposed assembly.

The second portion of this inventions assembly, as shown in FIG. 1, is the fluid transducer 25, that is actual device that imparts energy to the liquid and/or gas or mixtures thereof being produced in the well, that is for example a pump or a compressor, electrical motor assembly 21 and a portion 19 of the electrical connection receptacle, will be referred to herein as the retrievable assembly components.

In the embodiment shown in FIG. 1 a packer 4 with a polished bore receptacle 12 is disposed in the well production casing 1 via wireline methods, coiled tubing deployed methods or other methods well known to those familiar with the art of well construction. The next step of the process consists of deploying the permanently deployed assembly of this invention, typically consisting of an electrical power cable 15, seal bore extension, production tubing 18, electrical connector tailpipe with concentric electrical connector male adapter, an electrical connector male portion 35, and a polished bore receptacle 12 all run simultaneously and concentrically into the well casing 1. Once the tubing 14 and cable 15 are run to the proper depth in the well, the packer 4 attached to the production tubing 14 is set in the production casing 1 and the tubing hanger is landed in the well head. The well head is then flanged up on to the casing well head flange.

The retrievable component system, i.e. the electrical submersible motor 21, pump or compressor 25 and telemetry package 22, are lowered separately from surface concentrically through the production tubing 14 on wireline 34 or alternatively on coiled tubing, or jointed tubing. This assembly is pulled from electrical adapter set in the permanent assembly package using mechanical force as well as hydraulic pressure applied via the control line, when required. That is the retrievable system can be pulled for a variety of purposes, including but not limited to need for repair of equipment, a change in the pump, compressor, or motor sizes and capabilities, or to perform service or stimulation work to the well. This process then leaves the electrical cable 15, production tubing 14, and the male portion 35 of the electrical connector assembly in the well, allowing the electrical motor 21 to be disconnected from the male part 35 of the electrical receptacle. Once the appropriate changes or repairs have been made in the retrievable assembly it is deployed back into the production tubing, and connected to the male part 35 of the electrical receptacle.

This invention also can use a new and/or compressor design that allows for the pump or compressor to be a hydraulic sealing device inside of a polished bore receptacle 12 in the production tubing, otherwise known in the industry as a polished bore receptacle, PBR. This new pump and or compressor feature allows for and the pump's outer diameter housing to contain a seal or a plurality of seals 31 to form hydraulic sealing in the polished bore receptacle 12, such that the pump or compressors suction fluid pressure is separated from the their respective discharged pressure.

The transducer assembly used in this invention incorporates a new concept, such that on its outer diameter a sealing ring or a plurality of sealing rings 31, known as seals or o-rings. The transducer assembly is also configured to have a fishing neck on top such that the pump can be deployed and retrieved via the conventional art of wireline, or coiled tubing methods of running and pulling tools known to those familiar with the art of well services.

It is clear and evident to those familiar with the art of artificial lifting in the oil and gas industry, that many different types of pumps and or compressors can be used in the assembly deployed as a part of this invention. This invention then include but is not limited to centrifugal pumps, progressive cavity pumps, screw pumps, screw compressors, rotating compressors, counter rotating stator and rotor compressors, parallel screw transducer devices in any of these known derivative designs.

It will be understood that the invention can also be deployed with the production tubing, power cable, without the packer set on the production tubing in the production casing.

Additionally, it will be understood that the assembly of the pump, compressor, motor and other auxiliary equipment can be deployed with the production tubing on the initial completion, and subsequently retrieved by wireline or visa versa. This invention's deployment process and retrieval process allow the retrieval and subsequent future deployments of the pump, compressor, electrical motor, and auxiliary equipment to be accomplished without retrieving the power cable or production tubing. These deployment and retrieval processes include but are not limited to any of the well-known well service techniques, including but not limited to normal drilling or pulling rig assisted methods using jointed tubing run concentrically inside of the production tubing and latching on to the fishing neck, continuous coiled tubing and the subsequent retrieval methods with the coiled tubing concentrically inside of the production tubing, and wireline or wire rope methods with the wireline equipment used for deployment and retrieval run inside of the production casing.

It is also clear that an electrical submersible transducer system can be so designed to allow for hydraulic circulation methods to displace the down hole assembly in parts in it's respective component parts. In another embodiment the submersible electrical submersible system is retrieved by using wireline methods inside of the production casing assisted by hydraulic pumping pressure.

A preferred embodiment of this invention places the subsurface control or check valve 6 below the electrical connection 19, 35 as shown in FIG. 1 with the electrical motor 21, pump or compressor 25 and PBR 12 above the subsurface control valve 6. This embodiment further includes the packer 4 in the casing 1 attached to the production tubing 14, with the electrical power cable 15 deployed inside of the casing 1, and attached or banded to the production tubing 14. The electrical power cable is run through the packer 4 as well as the hydraulic control line 16 to the sub-surface control valve 6 to achieve hydraulic isolation of the formation fluids and pressure to surface by closing the subsurface control valve 6. The packer 4 is set in the production casing 1. This assembly allows the subsurface control valve 6 to be closed prior to pulling the pump or compressor 25, electrical motor 21 the transducer assembly, and auxiliary equipment in order to allow the well formation not to flow up the production tubing.

An alternative embodiment of this invention involves the placement of the electrical power cable 15 on the outside of the production casing 1. This embodiment is accomplished by attaching or banding the power cable 15 to the outside of the casing 1 whilst running the casing 1 into the well bore. The cable 15 is then cemented into place and remains behind the production casing 1, and connected to the male part of the electrical connector through an orifice in the casing 1.

I claim:

1. A method of deploying an electrically driven downhole fluid transducer system in a hydrocarbon fluid production well, the method comprising:

connecting an electrical power cable to a first part of a wet mateable electrical power connector which is secured to a lower region of a production tubing;

lowering the production tubing and the electrical power cable into the well;

lowering through the production tubing an electrically driven downhole fluid transducer system which is equipped with a second part of a wet mateable electrical power connector;

releasably latching the transducer system to the production tubing such that the two parts of the wet mateable power connector face each other;

injecting a dielectric fluid into a space between said electrical connector parts and sealing off said space to prevent influx of well fluids into said space; and activating the fluid transducer system by transmitting electrical power via the power cable and sealed electrical connector to the system;

wherein a hydraulic conduit is disposed to allow for the continual flooding and flushing of the electrical connector with dielectric fluids or gases.

2. The method of claim 1, wherein during the step of lowering the fluid transducer system through the production tubing, a check valve which is located near the lower end of the production tubing below the first part of the electrical connector is closed and fluid is circulated via an opening in the production tubing near the connector up through a hydraulic conduit or an annular space between the production tubing and a casing.

3. The method of claim 2, wherein a transducing system or a wireline or tubing used to dispose the transducer system into the well is equipped with a displacement plug section which provides a seal between the transducer system and the production tubing during at least part of the step of lowering of the fluid transducer system through the well and wherein well fluids are extracted through the hydraulic conduit or the annular space between the production tubing and the casing at a controlled rate to control and/or assist the descent of the fluid transducer system through the production tubing.

4. The method of claim 3, wherein the fluid transducer is retrieved to the surface by unlatching the transducer system from the production tubing mechanically with wireline to tubing forces or hydraulically with fluid forces created by pumping from the surface, closing the check valve and pumping fluid into the hydraulic conduit.

5. The method of claim 4, wherein the transducer assembly is provided with a telescoping cylinder which expands under hydraulic pressure created by pumping fluid down through the production tubing during a step of joining of the two parts of the electrical connector.

6. The method of claim 4 wherein the electrical submersible fluid transducer is disposed into the well with a continuous tube full of dielectric oil with a higher pressure than the well fluid pressure to maintain the fluid pressure inside of the transducer slightly higher than that of the well to avoid contaminants entering an electrical motor.

7. The method of claim 2, wherein the transducer system is deployed and retrieved multiple times in the well without retrieving the electrical power cable by connecting and disconnecting the two parts of the wet mateable connector and moving the transducer system through the well without retrieving the electrical power cable.

8. The method of claim 7, wherein the fluid transducer is retrieved to the surface by unlatching the transducer system from the production tubing mechanically with wireline to tubing forces or hydraulically with fluid forces created by pumping from the surface, closing the check valve and pumping fluid into the hydraulic conduit.

9. The method of claim 8, wherein the transducer assembly is provided with a telescoping cylinder which expands under hydraulic pressure created by pumping fluid down through the production tubing during a step of joining of the two parts of the electrical connector.

10. The method of claim 8 wherein the electrical submersible fluid transducer is disposed into the well with a continuous tube full of dielectric oil with a higher pressure than the well fluid pressure to maintain the fluid pressure inside of the transducer slightly higher than that of the well to avoid contaminants entering an electrical motor.

11. The method of claim 7, wherein during the steps of lowering and retrieving the fluid transducer system through the production tubing a wireline, jointed tubing lengths connected together, or coiled tubing is releasable secured by a fishing neck to the transducer system to facilitate or support the lowering or retrieval process.

12. The method of claim 11, wherein a latching device is located between the transducer assembly and a previously disposed part of the electrical connector.

13. The method of claim 2 wherein gas is injected into the conduit and displaces well fluids or solids from an electrical connector disposed permanently in the well before the two parts of the electrical connector are joined.

14. The method of claim 1, wherein the production tubing is an expandable tubing which is radially expanded before lowering the transducer assembly through the tubing.

15. The method of claim 1 wherein the hydraulic conduit is disposed on the outside of the production tubing and is used to form a fluid passage from the surface down into the well, through the electrical connector and into an electrical motor.

16. The method of claim 15 wherein no seal section or protector is used in the eLectrical fluid transducer.

17. The method of claim 1 wherein a pressure inside of the hydraulic conduit is maintained above the pressure of the well thus allowing for a continual flushing of dielectric oil or gas into an electrical motor, and bearings of an electrical fluid transducer.

18. The method of claim 1 wherein the electrical fluid transducer system is disposed initially together with the production tubing, power cable, and hydraulic conduits into the well.

19. The method of claim 1 wherein the hydraulic conduit is disposed on the outside of the production tubing and is used to form a fluid passage from the surface down into the well, through the electrical connector and into an electrical motor, and into a seal or protector section of an electrical submersible transducer conduit.

* * * * *